US007647692B2

(12) United States Patent
Lanoue et al.

(10) Patent No.: US 7,647,692 B2
(45) Date of Patent: Jan. 19, 2010

(54) METHOD OF MANUFACTURING A TRANSFORMER COIL HAVING COOLING DUCTS

(75) Inventors: Thomas J. Lanoue, Cary, NC (US); Michael J. Mitchell, Christiansburg, VA (US); William E. Pauley, Jr., Bland, VA (US); Charlie H. Sarver, Rocky Gap, VA (US)

(73) Assignee: ABB Technology AG, Zurich (CH)

( * ) Notice: Subject to any disclaimer, the term of this patent is extended or adjusted under 35 U.S.C. 154(b) by 4 days.

(21) Appl. No.: 11/353,582

(22) Filed: Feb. 14, 2006

(65) Prior Publication Data

US 2006/0200971 A1 Sep. 14, 2006

Related U.S. Application Data

(62) Division of application No. 10/026,199, filed on Dec. 21, 2001, now Pat. No. 7,023,312.

(51) Int. Cl.
*H01F 3/04* (2006.01)
*H01F 7/06* (2006.01)

(52) U.S. Cl. ..... 29/609; 29/602.1; 29/605; 29/606; 72/142; 72/144; 72/224; 310/179; 310/208; 336/212; 336/234; 336/60; 336/122

(58) Field of Classification Search ..... 29/592.1, 29/602.1, 604, 605, 609; 72/142, 144, 224, 72/242, 289; 242/443, 447.2, 437.3, 437.4, 242/478.1, 614.2, 25 R; 310/179, 208; 336/212, 336/234, 60, 122

See application file for complete search history.

(56) References Cited

U.S. PATENT DOCUMENTS

| | | | | |
|---|---|---|---|---|
| 3,170,134 | A | | 2/1965 | Palmer |
| 3,201,728 | A | | 8/1965 | McWhirter |
| 3,548,355 | A | | 12/1970 | Miller et al |
| 3,611,226 | A | | 10/1971 | Cotten et al. |
| 3,662,461 | A | | 5/1972 | Lake et al. |
| 3,711,807 | A | | 1/1973 | Yamashita et al. |
| 4,129,938 | A | | 12/1978 | Hagenbutcher |
| 4,239,077 | A | | 12/1980 | Dixon et al. |
| 4,279,944 | A | | 7/1981 | Laskaris |
| 4,435,242 | A | * | 3/1984 | McNulty ..... 156/264 |
| 4,474,845 | A | * | 10/1984 | Hagerman et al. ..... 428/297.4 |
| 4,488,134 | A | | 12/1984 | Pfeiffer |

(Continued)

FOREIGN PATENT DOCUMENTS

DE 1980 288 3/1968

(Continued)

OTHER PUBLICATIONS

AlliedSignal and Dynapower Announcement, 3 pages, Feb. 12, 1998.

(Continued)

*Primary Examiner*—Paul D Kim
(74) *Attorney, Agent, or Firm*—Paul R. Katterle

(57) ABSTRACT

A method of manufacturing a dry-type, resin-encapsulated transformer coil that includes forming a plurality of conductive layers and positioning a plurality of pre-formed plastic cooling ducts so as to be disposed between the conductive layers.

15 Claims, 5 Drawing Sheets

U.S. PATENT DOCUMENTS

| | | | | |
|---|---|---|---|---|
| 4,523,171 | A | 6/1985 | Altmann et al. | |
| 4,541,171 | A * | 9/1985 | Buckley | 29/605 |
| 4,874,916 | A | 10/1989 | Burke | |
| 5,267,393 | A | 12/1993 | Purohit et al. | |
| 5,383,266 | A | 1/1995 | Soter | |
| 5,396,210 | A | 3/1995 | Purohit et al. | |
| 5,455,551 | A | 10/1995 | Grimes et al. | |
| 5,588,201 | A | 12/1996 | Alber et al. | |
| 5,596,305 | A | 1/1997 | Puri | |
| 5,621,372 | A | 4/1997 | Purohit | |
| 6,147,580 | A | 11/2000 | Rettew et al. | |
| 6,150,464 | A | 11/2000 | Medsker et al. | |
| 6,160,464 | A | 12/2000 | Clarke et al. | |
| 6,221,297 | B1 | 4/2001 | Lanoue et al. | |
| 6,223,421 | B1 | 5/2001 | Lanoue et al. | |
| 6,368,530 | B1 * | 4/2002 | Adubato et al. | 264/154 |
| 7,023,312 | B1 | 4/2006 | Lanoue et al. | |

FOREIGN PATENT DOCUMENTS

| | | | |
|---|---|---|---|
| DE | 21041112 | | 8/1972 |
| DE | 2658774 | | 6/1978 |
| DE | 2854520 | | 6/1980 |
| DE | 3138909 | A1 | 4/1983 |
| EP | 0058783 | | 1/1982 |
| EP | 0576418 | B1 | 10/1992 |
| JP | 57118618 | | 7/1982 |
| JP | 59159515 | | 9/1984 |
| JP | 60072205 | | 4/1985 |
| JP | 04-064204 | | 2/1992 |
| JP | 07037724 | | 2/1995 |
| WO | WO 9834241 | | 8/1996 |
| WO | WO 9928926 | | 6/1999 |
| WO | WO03107364 | A1 | 12/2003 |

OTHER PUBLICATIONS

Dry Type Transformer, Features of Construction, 12 pages, available as of filing date, Oct. 2001.
Square D Groupe Schneider, Power-Cast Cast Coil Transformers, 5 pages, available as of filing date, 1996.
EP1461814 Examination Report.
EP1461814 Reply to Examination Report.
EP1461814 Intention to Grant Patent.
EP1461814 Notice of Opposition.
EP1461814 Response to Opposition.
CBD-159 Thermosetting Plastics.

* cited by examiner

METHOD OF MANUFACTURING A TRANSFORMER COIL HAVING COOLING DUCTS

CROSS CROSS-REFERENCE TO RELATED APPLICATION

This application is a divisional application of, and claims priority from, U.S. patent application Ser. No. 10/026,199 filed on Dec. 21, 2001 now U.S. Pat. No. 7,023,312, which is hereby incorporated by reference in its entirety.

BACKGROUND OF THE INVENTION

The present invention relates to the field of electrical transformers, and, more particularly to a dry-type, resin-encapsulated transformer coil having permanently installed cooling ducts that are thermally and electrically compatible with the resin encapsulating the coil.

The design and reliability of transformer coils has steadily improved over the last several decades. Today, dry-type encapsulated transformer coils are either coated with resins or cast in epoxy resins using vacuum chambers and gelling ovens. Epoxy provides excellent protection for the transformer coil; however, it can create a problem with heat dissipation. To dissipate the heat from around the coil, cooling ducts are formed at predetermined positions within the coil to aid cooling, improve the operating efficiency of the coil, and extend the operational life of the coil.

The conventional method of creating cooling duct passages is to place solid spacers between successive layers of conductive material during the winding process. Solid metal, cloth-wrapped metal, and greased elastomeric spacers all have been used, as well as shims to create gaps between the layers of the coil. After encapsulating the coil, the spacers then are removed. Regardless of the type of spacers used, the process can result in inefficiencies and the potential for damage, as the spacers must be forcibly removed with pulling devices or overhead cranes. The spacers quite often are damaged while being removed, thus requiring repair or replacement.

Duct spacers, such as aluminum, can also cause damage to the coil in a variety of ways. Stress fractures can form in the coil during the curing process due to the differences in thermal expansion and contraction between the epoxy resin and the aluminum spacers. As mechanical fractures also may be created in the cured coil during removal of the spacers, a minimum spacing requirement between spacers reduces the number of cooling ducts that can be formed in the coil. This in turn creates an incremental increase in the required thickness of the conductive material needed to adequately dissipate heat during operation. Further, chips or blocks of epoxy often break away from the coil while the spacers are being removed, rendering the encapsulated coil useless for its intended purpose.

SUMMARY OF THE INVENTION

In accordance with the present invention, a method is provided for manufacturing an electrical transformer coil. The method includes providing a mandrel, a plurality of pre-formed plastic cooling ducts and conductive material. The conductive material is wound around the mandrel to form a plurality of layers. During the winding, the pre-formed plastic cooling ducts are positioned so as to be disposed between the layers. The layers with the pre-formed plastic cooling ducts disposed in-between are encapsulated in a resin.

Also in accordance with the present invention, a method of manufacturing an electrical transformer is provided. The method includes producing a coil, which includes providing a mold, conductive material and first and second plastic cooling ducts. The conductive material is placed over the mold to form a first conductive layer. The first plastic cooling duct is placed over the first conductive layer. The conductive material is placed over the first plastic cooling duct so as to form a second conductive layer and such that the first plastic cooling duct is disposed between the first and second conductive layers. The second plastic cooling duct is placed over the second conductive layer. The conductive material is placed over the second plastic cooling duct so as to form a third conductive layer and such that the second plastic cooling duct is disposed between the second and third conductive layers. The first, second and third conductive layers, with the first and second plastic cooling ducts disposed in-between, are encapsulated in a resin.

Further in accordance with the present invention, a method of manufacturing an electrical transformer coil is provided, which includes providing a mandrel, conductive material and insulating material and a pre-formed plastic cooling duct having an enclosed periphery with open ends and an interior passage extending between the open ends. The conductive material and insulating material are wound around the mandrel to form alternating insulating and conductive layers. During the winding, the pre-formed plastic cooling duct are positioned so as to be disposed between one of the conductive layers and one of the insulating layers. The conductive and insulating layers, with the pre-formed plastic cooling duct disposed in-between, are encapsulated in a resin.

DETAILED DESCRIPTION OF ILLUSTRATIVE EMBODIMENTS

Figure 1:
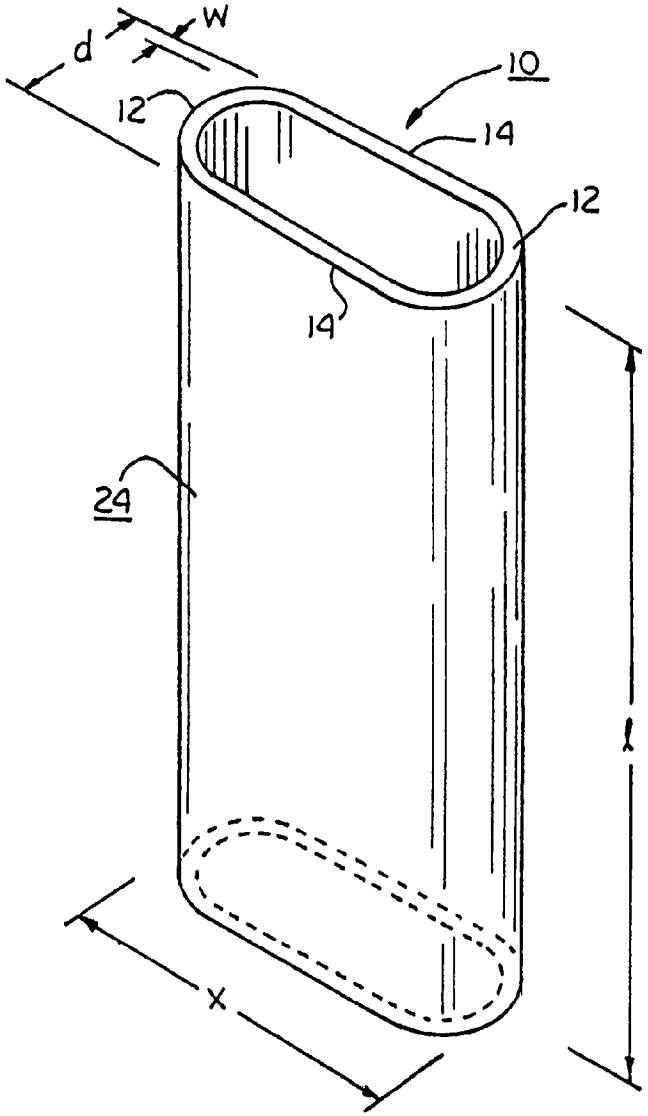
FIG. 1 is a perspective view of the resin cooling duct of the present invention.

As shown in FIG. 1, one aspect of the present invention is directed to a tube 10, for permanent installation as a cooling duct in a resin-encapsulated transformer coil. The tube has a cross-section that is generally elliptical, with rounded ends 12 and substantially straight sides 14. While the precise geometry of the tube is not critical to the present invention, it has been found that, when the linear dimension, x, of the tube is about three times the width, d, of the tube, the tube is optimally shaped for placement between the alternating layers of a wound coil. With these relative dimensions, the tube is also structurally optimized, and provides optimal heat transfer from resin-encapsulated systems, such as transformer coils. By way of example, one tube constructed according to the present invention has a linear dimension, x, of about 2.7 inches, a width, d, of about 0.9 inches, and a wall thickness, w, of about 0.1 inches. As will be described in greater detail below, the tube is designed to withstand a vacuum of at least one millibar during a vacuum casting procedure.

The tube of the present invention preferably is formed from a suitable thermoplastic material, such as a polyester resin, in a pultrusion manufacture. Pultrusion is a process for producing a continuous length of a fiber-reinforced polymer profiled shape, such as a tube or cylinder, in which coated fibers are drawn through a heated die to produce a high strength shape. An example of the polyester resin used to form the tube is EI 586 Polyglas M, available from Resolite of Zelienople, Pa. The pultruded tube is reinforced with fiberglass filaments aligned as either unidirectional roving or a multi-directional mat. The reinforcing configuration used in the tube of the present invention includes an outer fiberglass reinforcing mat and an inner fiberglass reinforcing mat. The tube, once formed, is cured beyond B-stage by any of the conventional methods known in the art for such curing. For integration into a dry-type, encapsulated transformer coil, certain material properties are required. The tube described herein, when tested in accordance with ASTM D-638, "Standard Test Method for Tensile Properties of Plastics," has an ultimate tensile strength of about 30,000 psi longitudinally, 6,500 psi transverse; an ultimate compressive strength of about 30,000 psi longitudinally, 10,000 psi transverse per ASTM D-695, "Standard Test Method for Compressive Properties of Rigid Plastics", and, an ultimate flexural strength, when tested in accordance with ASTM D-790, "Standard Test Method for Flexural Properties of Unreinforced and Reinforced Plastics and Electrical Insulating Materials" of about 30,000 psi longitudinally, 10,000 psi transverse. The modulus of elasticity is approximately 2.5E6 psi longitudinally per ASTM D-149, Standard Test Method for Dielectric Breakdown Voltage and Dielectric Strength of Solid Electrical Insulating Materials at Commercial Power Frequencies." Electrically, the tube has an electrical strength short time (in oil), per ASTM D-149, of about 200 V/mil (perpendicular) and 35 kV/inch (parallel). Preferably, the thermal conductivity of the tube is at least about 4 Btu/(hr*ft$^2$*° F./in).

The length, 1, of the tube is entirely dependent upon the application; i.e., the pultruded tube is cut to length for the particular transformer application. As explained in greater detail below, the overall length of the tube will be less than the overall height of the wound transformer coil, so that the tube is completely encased, with the end edges of the tube bound to the cured resin. In a preferred embodiment of the present invention, the tube described above is permanently installed in a dry-type, resin-encapsulated transformer coil.

Figure 3:
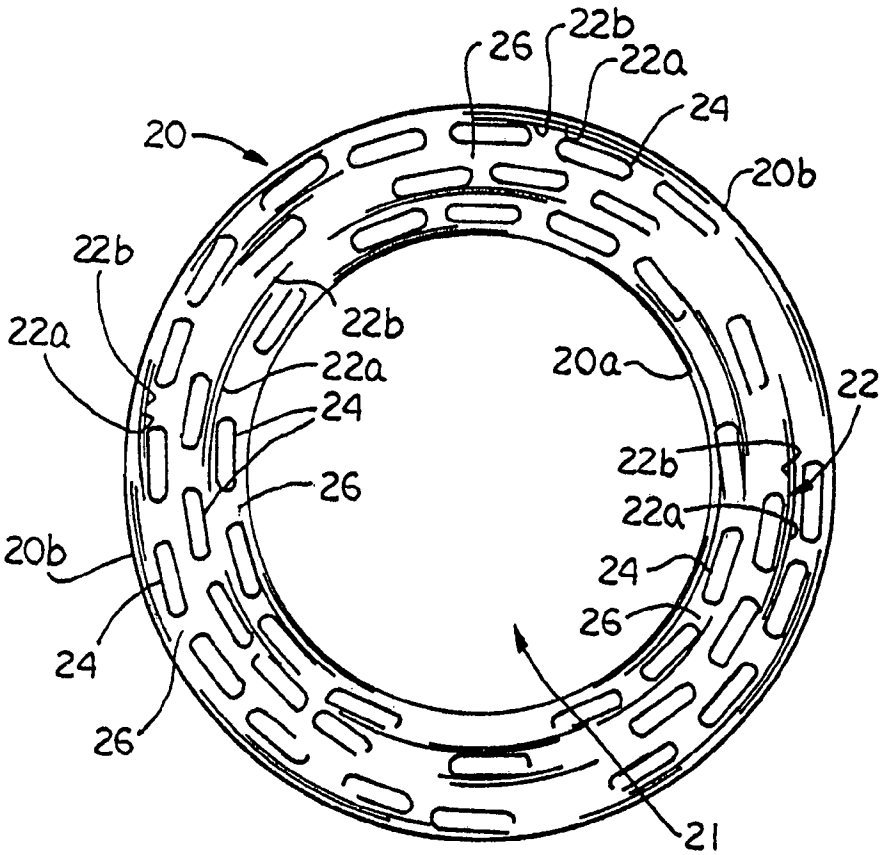
FIG. 3 is a cross-sectional view of the transformer coil of FIG. 2, taken along Line 3-3.
Figure 2:
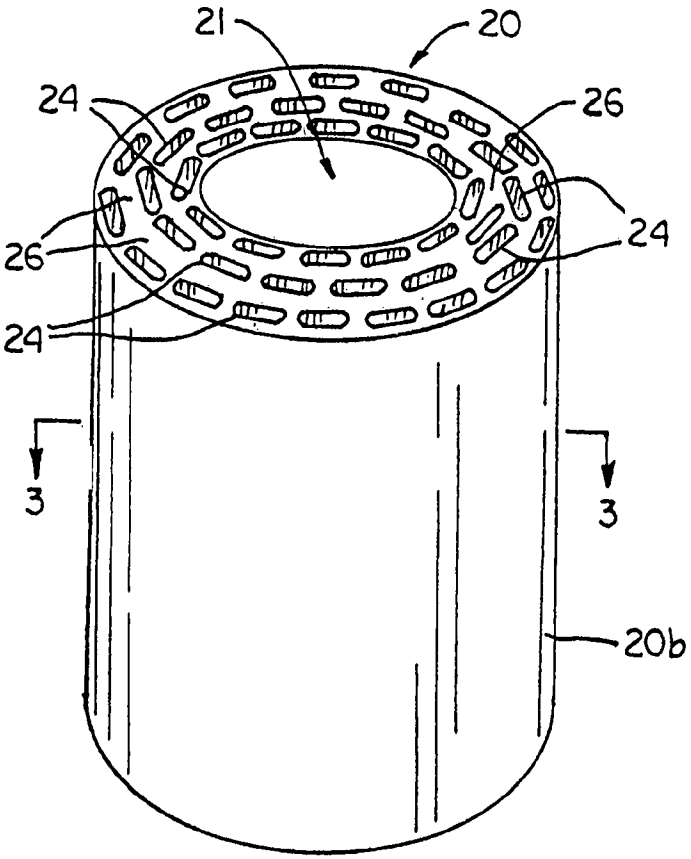
FIG. 2 is a perspective view of a dry-type, resin-encapsulated transformer coil with permanently installed resin cooling ducts.

Referring to FIGS. 2 and 3, the dry-type, resin-encapsulated transformer coil 20 comprises a coil 22, a plurality of integrated cooling ducts 24, and a resin 26 encapsulating the coil 22. When formed, the body of the transformer coil 20 is defined between inner surface 20*a* and outer surface 20*b*, both shaped by molds, as described below. The inner surface 20*a* circumferentially defines an open area or core 21, formed as described in greater detail below. The coil 22, as wound about the core 21, consists of alternating layers of conductor sheeting 22*a* and insulating sheeting 22*b*. As the conductor sheeting 22*a* and insulating sheeting 22*b* are continuously wound about the core 21, cooling ducts 24, formed as the tubes described above, are inserted and interspaced between successive layers. The cooling ducts of the present invention are permanently incorporated into the encapsulated transformer coil. The addition of integrated cooling ducts 24 improves the dielectric strength of the coil. As used herein, and as generally defined in the industry, "dielectric strength" refers to the maximum electrical potential gradient that a material can withstand without rupture. Not only do the integrated cooling ducts 24 have desirable dielectric characteristics, but also they add an additional dielectric barrier to the wound coil 22. This increases the durability and service longevity of the coil 22. As these integrated cooling ducts 24 of resin construction also increase the cooling capacity of each layer of coil 22, the thickness of conductor 22*a* required for optimal performance may be decreased. For example, the thickness of the conductor sheeting 22*b* may vary from about 0.020 inches to 0.180 inches, with the spacing between integrated ducts ranging from about 0.125 inches to 1.0 inches. Therefore, since resin breakage due to duct bar or spacer removal is not a concern with the integrated cooling duct construction, the integrated ducts 24 also may be placed more closely together, permitting the total number of cooling ducts 24 to increase, with a proportional increase in cooling capacity. As the number of integrated ducts increases, the required thickness of the conductor 22*a* decreases.

The wound transformer coil 20 is encapsulated by an epoxy resin 26 that is poured in the volume between inner and outer molds. The encapsulating resin is available from Bakelite AG of Iserlohn, Gemany as Rutapox VE-4883. This thermosetting resin is electrically and thermally compatible with the polyester resin construction of the cooling ducts 24. Once encapsulated and cured, the construction of the transformer coil is complete.

The present invention also provides a method of manufacturing a transformer coil encapsulated in a casting resin. While there are several manufacturing methods for constructing the dry-type, resin-encapsulated transformer coil of the present invention, one method is to utilize a disposable wrap and band mold with an integrated winding mandrel. This method, as will be only summarized herein, is described in U.S. Pat. No. 6,221,297 to Lanoue et al., the content of which is incorporated herein in its entirety.

Figure 4:
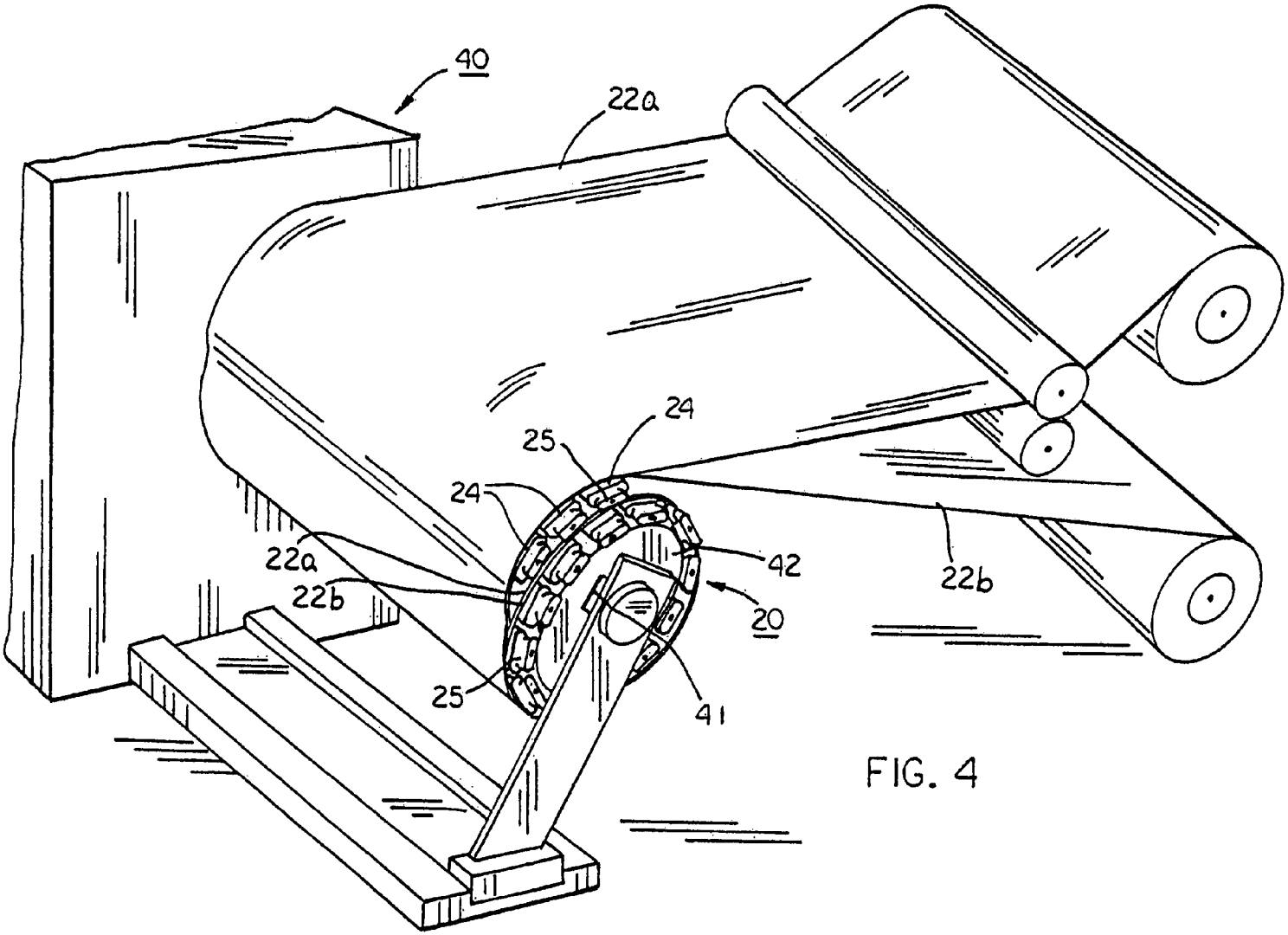
FIG. 4 is a perspective view illustrating the steps of winding a length of conductive material to form a coil, and positioning a plurality of resin cooling ducts between layers of conductive material.

As shown in FIG. 4, a coil winding machine 40, having a conventional mandrel 41, is used to produce a coil 20, having a substantially circular shape. Once an inner mold 42 of sheet metal or other suitable material is mounted on the mandrel 41 to form the core, it is ready to have the coil wound thereon. The inner mold 42 typically is first wrapped with a glass grid insulation (not shown), followed by a first winding, or layer, of the coil 22. As best seen in FIG. 4, the coil 22 is wound from alternate layers of copper conductor sheeting 22*a* and insulating sheeting 22*b*. The thickness of the insulation sheeting is also dependent upon the particular transformer coil configuration, but in embodiments constructed according the present invention, may vary from between about 0.005 inches and 0.030 inches. During the winding process, the cooling ducts 24 are inserted between layers of conductor 22*a* to provide cooling ducts in the completed transformer. As will be appreciated, the integrated cooling ducts 24 may be inserted between each layer of conductor 22*a*, between alternating layers, etc., again dependent upon the particular transformer coil construction.

Figure 5B:
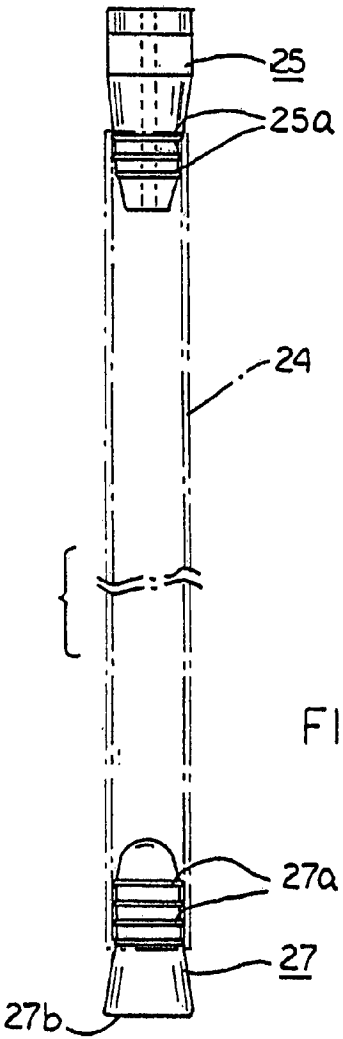
FIG. 5B is an end view of the plugs of FIG. 5A.
Figure 5A:
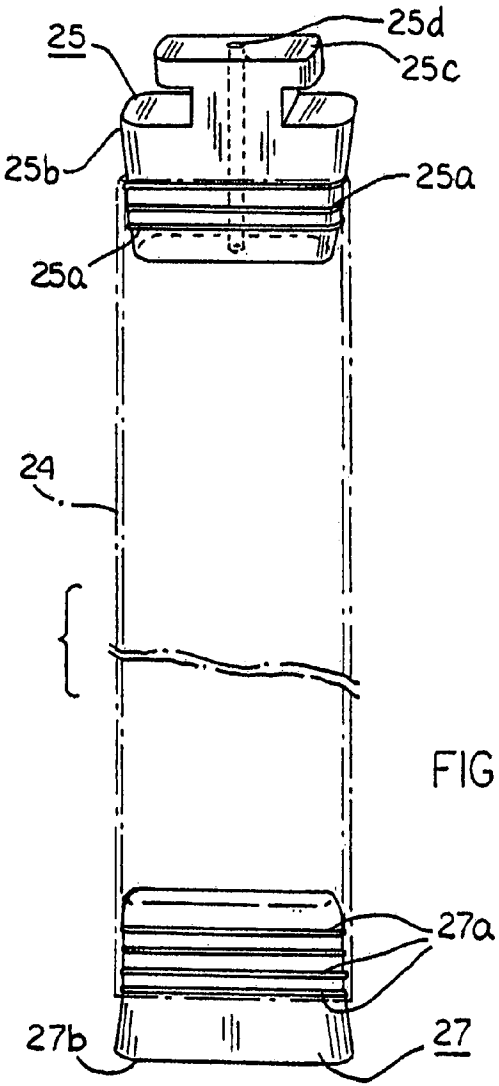
FIG. 5A is a perspective side view of the plugs for temporary installation in the ends of the resin cooling ducts of the present invention.

Duct plugs 25, 27, which may be installed at any time prior to resin encapsulation of the coil 22, are inserted into the open ends of cooling ducts 24 to keep resin from flowing into ducts 24 during the resin encapsulation. FIGS. 5A and 5B illustrate in an environmental view the relative placement and geometry of the plugs 25, 27. The top plug 25 is dimensioned to frictionally fit within the top opening of a cooling duct 24. As used herein, the "top" of the cooling duct is on that end of the coil from which the coil leads (not shown) extend. The top plug 25 is tapered inward (i.e., downward), and has ribs 25*a* around its periphery to ensure a positive seal with the inner surface of the cooling duct 24. The outer (i.e., upward) body 25*b* of the plug is tapered outward slightly so that it can be easily removed from the surrounding cured resin following encapsulation. A handle or gripping portion 25*c* facilitates removal after the curing process. Because the plugs 25, 27 will seal each end of each cooling duct 24 during the resin encapsulation and curing process, an open passage or relief vent 25*d* is formed through plug 25 to prevent collapse of the cooling duct 24. A bottom plug 27 performs the same function as the top plug, except that a vacuum relief is not required and a handle is not needed. Bottom plug 27 also has ribs 27*a* for frictional engagement with the inner walls of the cooling duct 24. The outermost end 27*b* of plug 27 is substantially flat so that the coil may be uprighted and seated with the bottom end on a mat for the subsequent resin encapsulation.

Figure 6:
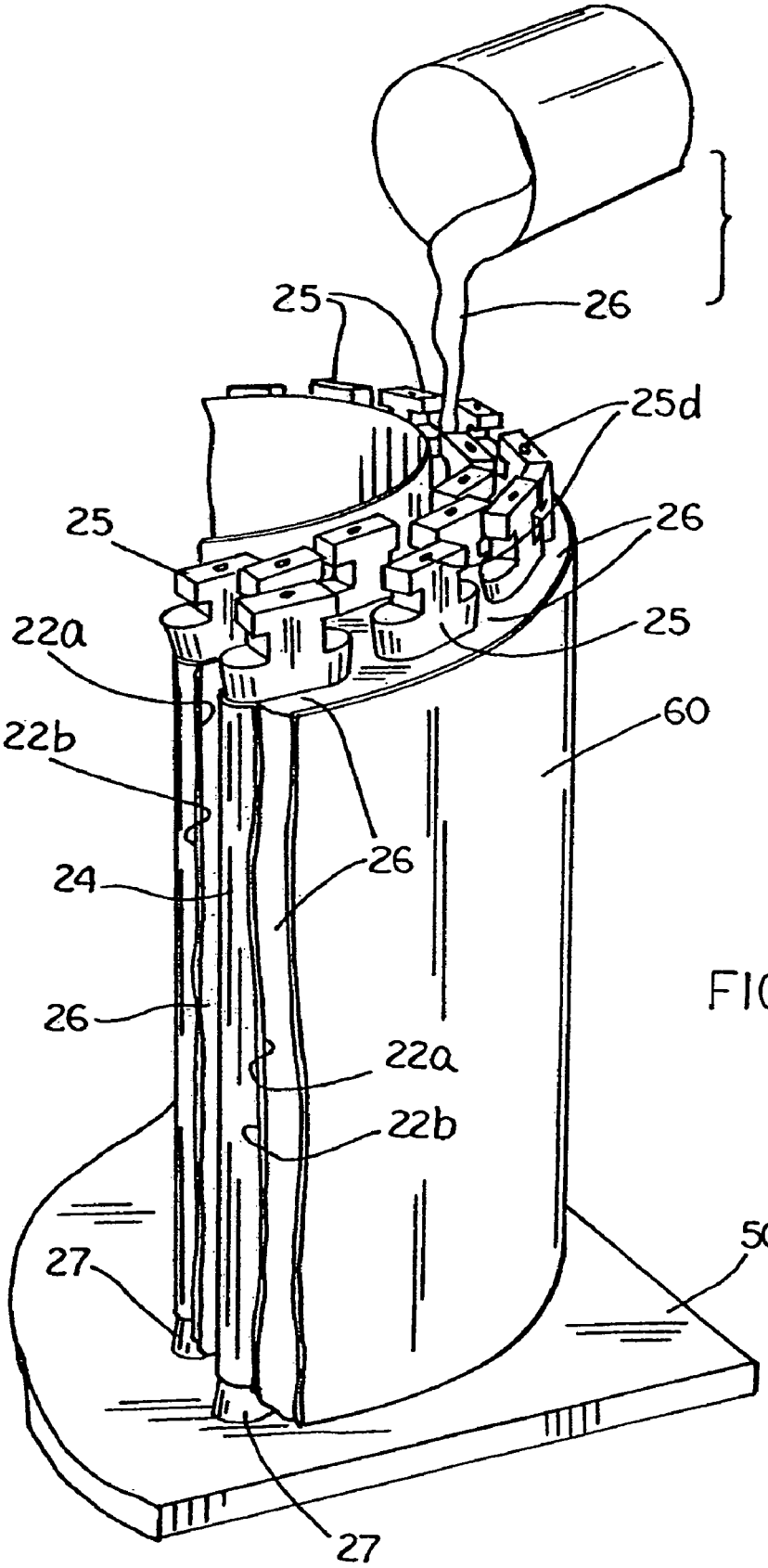
FIG. 6 is a perspective, cut-away, view illustrating the steps of placing the outer mold around the coil and filling the volume between the inner and outer molds with a resin.

Following the winding of the coil 22 into the desired number of layers, and having placed a sufficient number of cooling ducts 24 between the layers, the coil is removed from the winding machine 40 and uprighted with the top plugs facing upward. The coil 20 is placed on a mat 50 of silicone or other suitable material that may be compressed. When so placed, the flat ends 27*b* of bottom plugs 27 will be pressed against the mat 50. The outer mold then is ready to be wrapped around the uprighted coil 20. As best seen in FIG. 6, an outer mold 60 surrounds coil 20. Outer mold 60 is formed of a sheet metal or other rigid material that is fastened, or banded around coil 20, leaving a gap between the mold 60 and the coil 20 so that encapsulation will be total. Lanoue et at. discloses one construction for the outer mold, but other suitable forms of molds well known in the art may be used. Compression of the outer mold 60 against the silicone mat 50 will prevent epoxy leaks from the bottom of the coil during the encapsulation process.

With the outer mold 60 in place, the epoxy encapsulation may proceed. A flowing epoxy resin 26 is poured into the mold to encapsulate the coil, and to encase the spaced cooling ducts 24. When poured, the epoxy resin 26 settling into the lower spaces between the inner and outer molds will surround bottom plugs 27 to a depth substantially even with the flat portions 27*b* of plugs 27. The resin will be poured until it extends about 3/16 inches above the top edges of the cooling duct 24 upper ends.

The curing process is conventional and well known in the art. For example, the cure cycle may comprise a (1) gel portion for about 5 hours at about 85 degrees C., (2) a ramp up portion for about 2 hours where the temperature increases from about 85 degrees C. to about 140 degrees C., (3) a cure portion for about 6 hours at about 140 degrees C., and (4) a ramp down portion for about 4 hours to about 80 degrees C. Following curing, the inner and outer molds are removed. The top plugs 25 may be easily removed with pliers or other gripping devices without damaging the surrounding resin. The bottom plugs may be removed by inserting a bar or rod (not shown) through the top end of each cooling duct and punching out the bottom plugs.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A method of manufacturing an electrical transformer coil comprising:

providing a mandrel;

providing a plurality of pre-formed plastic cooling ducts;

providing conductive material;

winding the conductive material around the mandrel to form a plurality of layers;

during the winding, positioning the pre-formed plastic cooling ducts so as to be disposed between the layers;

encapsulating the layers with the pre-formed plastic cooling ducts disposed in-between in a resin;

placing plugs in opposing open ends of each of the pre-formed plastic cooling ducts before the layers and the pre-formed plastic cooling ducts are encapsulated in the resin;

removing the plugs after the layers and the pre-formed plastic cooling ducts are encapsulated in the resin; and allowing the resin to cure while the cooling ducts remain disposed between the layers, thereby permanently incorporating the cooling ducts into the electrical transformer coil.

2. The method of claim 1, wherein the electrical transformer coil is formed so as to be cylindrical, and wherein the pre-formed plastic cooling ducts are positioned so as to be radially spaced apart.

3. The method of claim 1, wherein each of the pre-formed plastic cooling ducts is formed by pultrusion from a second resin.

4. The method of claim 3, wherein the resin used to encapsulate the layers and the pre-formed plastic cooling ducts is an epoxy resin, and wherein the second resin is a polyester resin.

5. The method of claim 1, further comprising placing a mold over the mandrel, and wherein the conductive material is wound over the mold.

6. The method of claim 5, further comprising removing the mold after the layers and the pre-formed plastic cooling ducts are encapsulated in the resin.

7. The method of claim 1, wherein each pre-formed plastic cooling duct has an enclosed periphery with open ends and an interior passage extending between the open ends.

8. The method of claim 1, wherein each of the pre-formed plastic cooling ducts comprises polyester resin reinforced with fiberglass filaments.

9. The method of claim 1, wherein the conductive material comprises conductor sheeting.

10. The method of claim 9, wherein the pre-formed plastic cooling ducts are disposed around the circumference of the electrical transformer coil.

11. The method of claim 10, wherein the pre-formed plastic cooling ducts are disposed between successive layers of the conductor sheeting.

12. A method of manufacturing an electrical transformer coil comprising:

providing a mandrel;

providing a plurality of pre-formed plastic cooling ducts;

providing conductive sheet material;

winding the conductive sheet material around the mandrel to form a plurality of conductive layers;

during the winding, positioning the pre-formed plastic cooling ducts so as to be disposed between successive conductive layers;

encapsulating the conductive layers with the pre-formed plastic cooling ducts disposed in-between in a resin; and allowing the resin to cure while the pre-formed plastic cooling ducts remain disposed between the layers, thereby permanently incorporating the pre-formed plastic cooling ducts into the electrical transformer coil.

13. The method of claim 12, wherein the method further comprises:

providing insulating sheet material; and winding the insulating sheet material to form a plurality of insulating layers, the winding of the insulating sheet material being performed during the winding of the conductive sheet material such that the insulating layers and the conductive layers are alternating.

14. The method of claim 13, wherein the pre-formed plastic cooling ducts are disposed around the circumference of the electrical transformer coil.

15. The method of claim 14, wherein the conductive sheet material has a width equal to the axial length of the electrical transformer coil.

* * * * *